United States Patent [19]

Boyadjieff et al.

[11] 4,437,515

[45] Mar. 20, 1984

[54] POSITIONING OF WELL PIPE JACK IN A RIG

[75] Inventors: George I. Boyadjieff, Anaheim; Andrew B. Campbell, San Marino, both of Calif.

[73] Assignee: Varco International, Inc., Orange, Calif.

[21] Appl. No.: 333,111

[22] Filed: Dec. 21, 1981

[51] Int. Cl.[3] ..... E21B 7/20

[52] U.S. Cl. ..... 166/77; 166/77.5; 175/5

[58] Field of Search ..... 166/77, 77.5, 78, 335; 173/147, 165; 175/5, 195, 85

[56] References Cited

U.S. PATENT DOCUMENTS

| | | | |
|---|---|---|---|
| Re. 25,680 | 11/1964 | Brown | 254/29 R |
| 1,883,070 | 10/1932 | Stone | 175/171 |
| 1,894,039 | 11/1933 | Hill | 175/325 |
| 2,090,854 | 8/1937 | Timbs | 254/29 R |
| 2,126,933 | 8/1938 | Stone et al. | 175/171 |
| 2,202,126 | 8/1942 | Isley | 175/25 |
| 2,641,444 | 6/1953 | Moon | 175/171 |
| 2,661,063 | 12/1953 | Owens | 166/301 |
| 2,927,774 | 3/1960 | Ormsby | 175/195 |
| 3,180,617 | 4/1965 | Brown | 254/30 |
| 3,257,099 | 6/1966 | Merritt, Jr. | 254/105 |
| 3,316,963 | 5/1967 | Boldrick et al. | 166/298 |
| 3,363,688 | 1/1968 | Bielstein | 166/78 |
| 3,404,741 | 10/1968 | Gheorghe et al. | 166/77.5 |
| 3,722,603 | 3/1973 | Brown | 173/159 |
| 4,162,704 | 7/1979 | Gunther | 166/77.5 |
| 4,348,920 | 9/1982 | Boyadjiett | 175/85 |
| 4,351,398 | 9/1982 | Prins et al. | 175/195 |

FOREIGN PATENT DOCUMENTS 1229327 4/1971 United Kingdom .

*Primary Examiner*—Stephen J. Novosad
*Assistant Examiner*—William P. Neuder
*Attorney, Agent, or Firm*—William P. Green

[57] ABSTRACT

A jacking mechanism for lowering a string of casing or other well pipe into a well includes two structures which extend generally vertically beneath the floor of a drilling rig and which have portions functioning as power operated actuating units for moving one of two pipe supporting units upwardly and downwardly relative to the other, with the two specified generally vertical structures being offset circularly about the well axis from the location of a tubular mousehole element, and with one or more blowout preventers beneath the rig floor having a portion projecting outwardly away from the well axis at a location circularly between one of the generally vertical structures of the jacking mechanism and the mousehole.

15 Claims, 10 Drawing Figures

FIG. 1
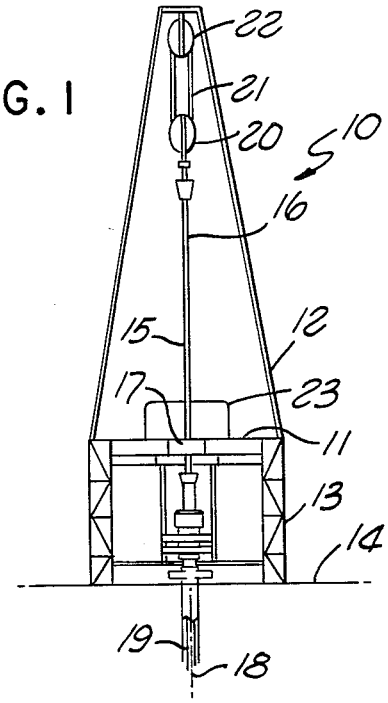
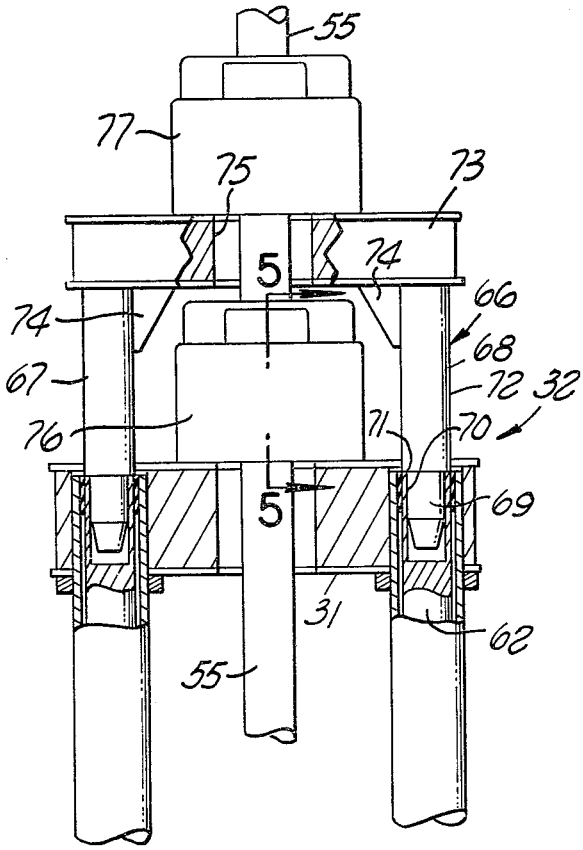
FIG. 3
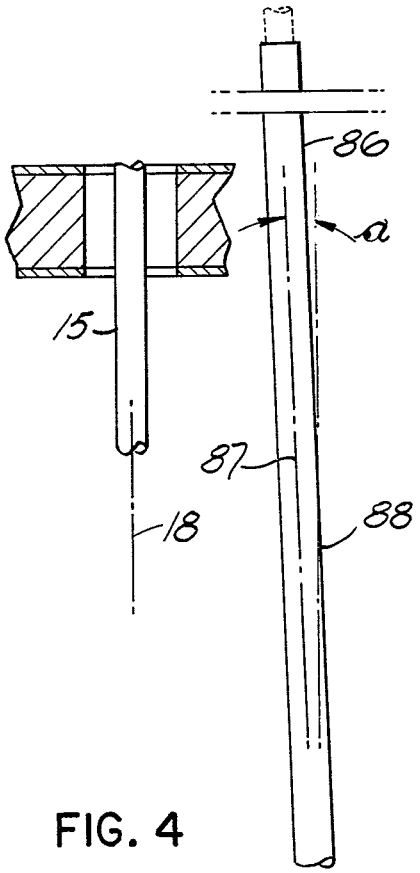
FIG. 4
FIG. 5
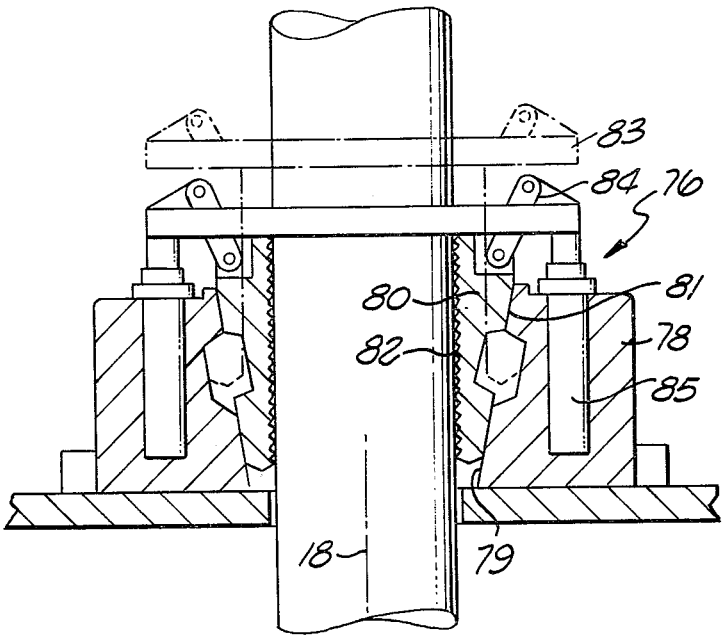

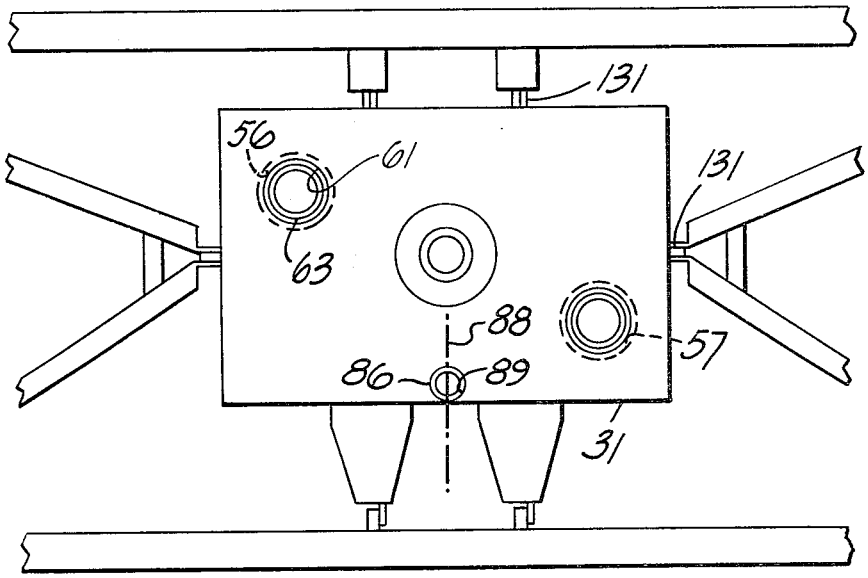
FIG. 6
FIG. 7
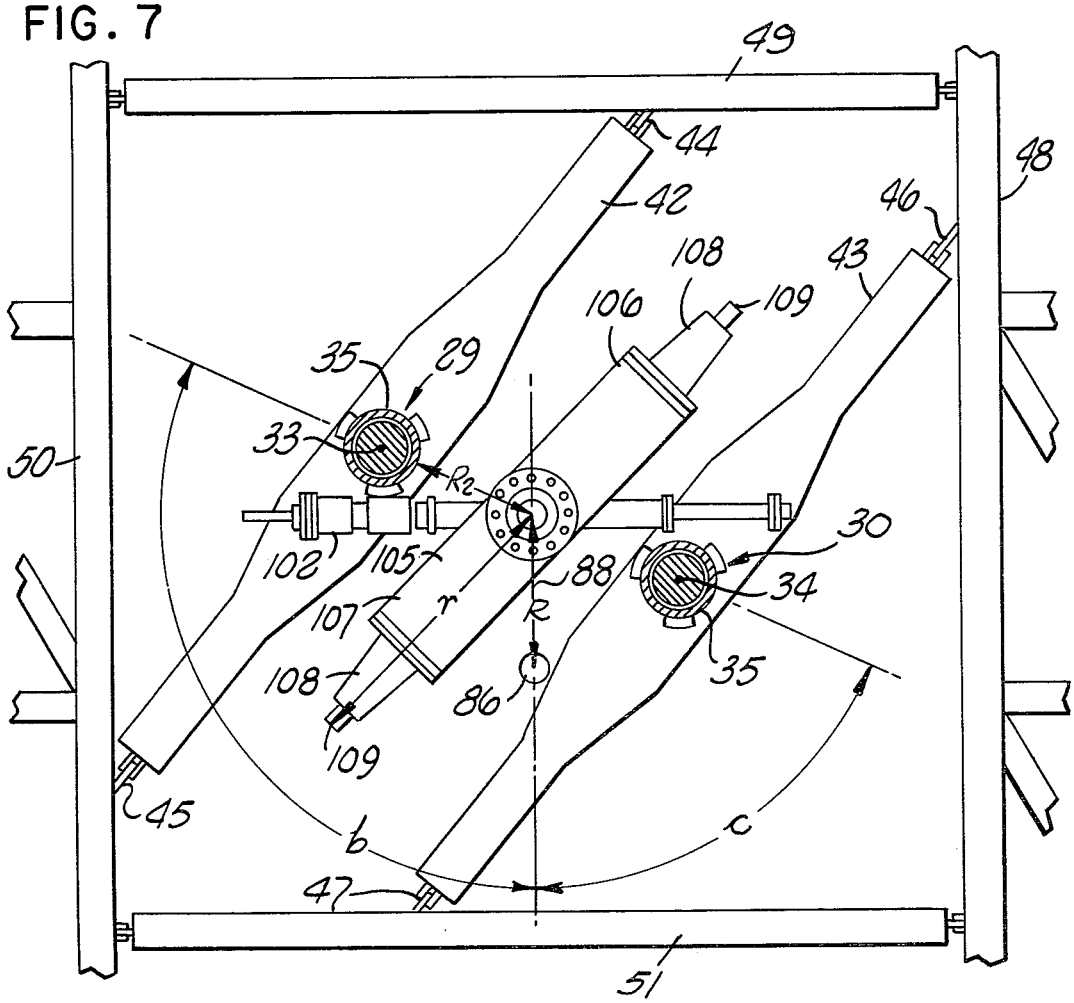

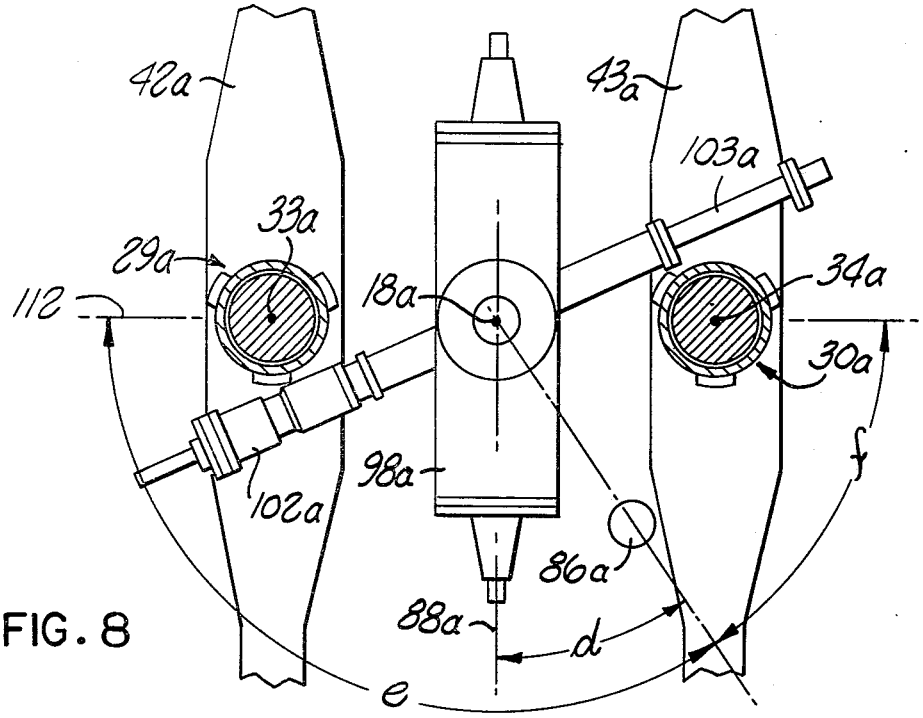
FIG. 8
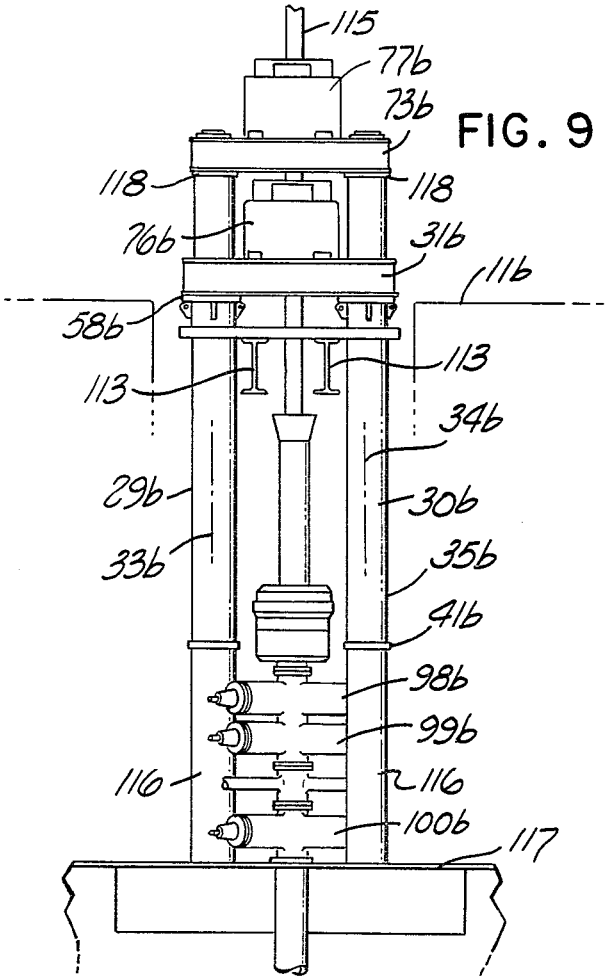
FIG. 9
FIG. 10
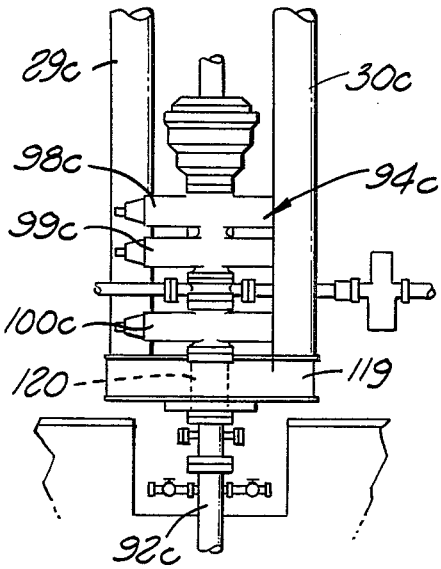

POSITIONING OF WELL PIPE JACK IN A RIG

BACKGROUND OF THE INVENTION

This invention relates to jacking mechanism for moving a string of well pipe essentially vertically along the axis of a well and relative to a drill rig.

The jacking mechanism of the present invention is of a general type disclosed in several prior copending patent applications and which is especially adapted in certain respects for lowering a lengthy and heavy string of casing into a well after drilling of the well. The jacking mechanism may be capable of handling a casing load of greater weight than could be suspended and lowered by the derrick, traveling block, lines, and drawworks of the rig, and thus may serve to effectively adapt a rig of relatively low capacity for handling heavy loads of casing during completion of the well. The jacking mechanism preferably includes a plurality of structures which extend downwardly beneath the rig floor generally parallel to one another and at different sides of the well axis, and which have portions serving as actuating units for moving one of two pipe supporting units upwardly and downwardly relative to the other to progressively lower an engaged string of pipe into the well. The two actuating units desirably take the form of piston and cylinder mechanisms extending generally vertically and connected to one of the pipe supporting units to move it upwardly and downwardly.

The present invention is especially concerned with a unique manner of positioning portions of a jacking mechanism of the above discussed type and other parts of a drill rig together beneath a rig floor, in a relation enabling reception of these various elements in a relatively confined space without adversely affecting the operation or accessibility of any of the parts. More specifically, the invention contemplates a unique relation between the jacking mechanism, a tubular mousehole member of the rig, and one or more ram type blowout preventers.

In accordance with the invention, the mentioned generally vertical subfloor structures of the jacking mechanism are positioned at locations offset circularly about the well axis from the mousehole, with the blowout preventer or preventers being located at approximately the well axis and projecting laterally outwardly at a location circularly between one of the subfloor structures of the jacking mechanism and the mousehole. In some arrangements, the blowout preventer may project outwardly at a location circularly between the mousehole and a power cylinder of one of the actuating units of the jacking mechanism. In other instances, one or more of the ram type blowout preventers may project outwardly at a level below the lower end of such a cylinder, and circularly between the mousehole and a support or base which takes load forces from the cylinder.

BRIEF DESCRIPTION OF THE DRAWINGS

The above and other features and objects of the invention will be better understood from the following detailed description of the typical embodiments illustrated in the accompanying drawings, in which:

FIG. 1 is a schematic representation of a well drilling rig having apparatus beneath the rig floor assembled in the relationship taught by the present invention;

FIG. 3 is a fragmentary partial vertical sectional view showing the apparatus of FIGS. 1 and 2 in casing lowering condition;

FIG. 4 is a fragmentary schematic view taken essentially on vertical line 4—4 of FIG. 2 and illustrating the inclination of the mousehole;

FIG. 5 is an enlarged fragmentary vertical section taken on line 5—5 of FIG. 3;

FIG. 6 is a fragmentary horizontal section taken on line 6—6 of FIG. 2;

FIG. 7 is a horizontal section taken on line 7—7 of FIG. 2;

FIG. 8 is a view similar to FIG. 7 but showing a variational arrangement; and

FIGS. 9 and 10 are schematic representations of two additional variational forms of the invention.

DESCRIPTION OF THE PREFERRED EMBODIMENTS

Figure 2:
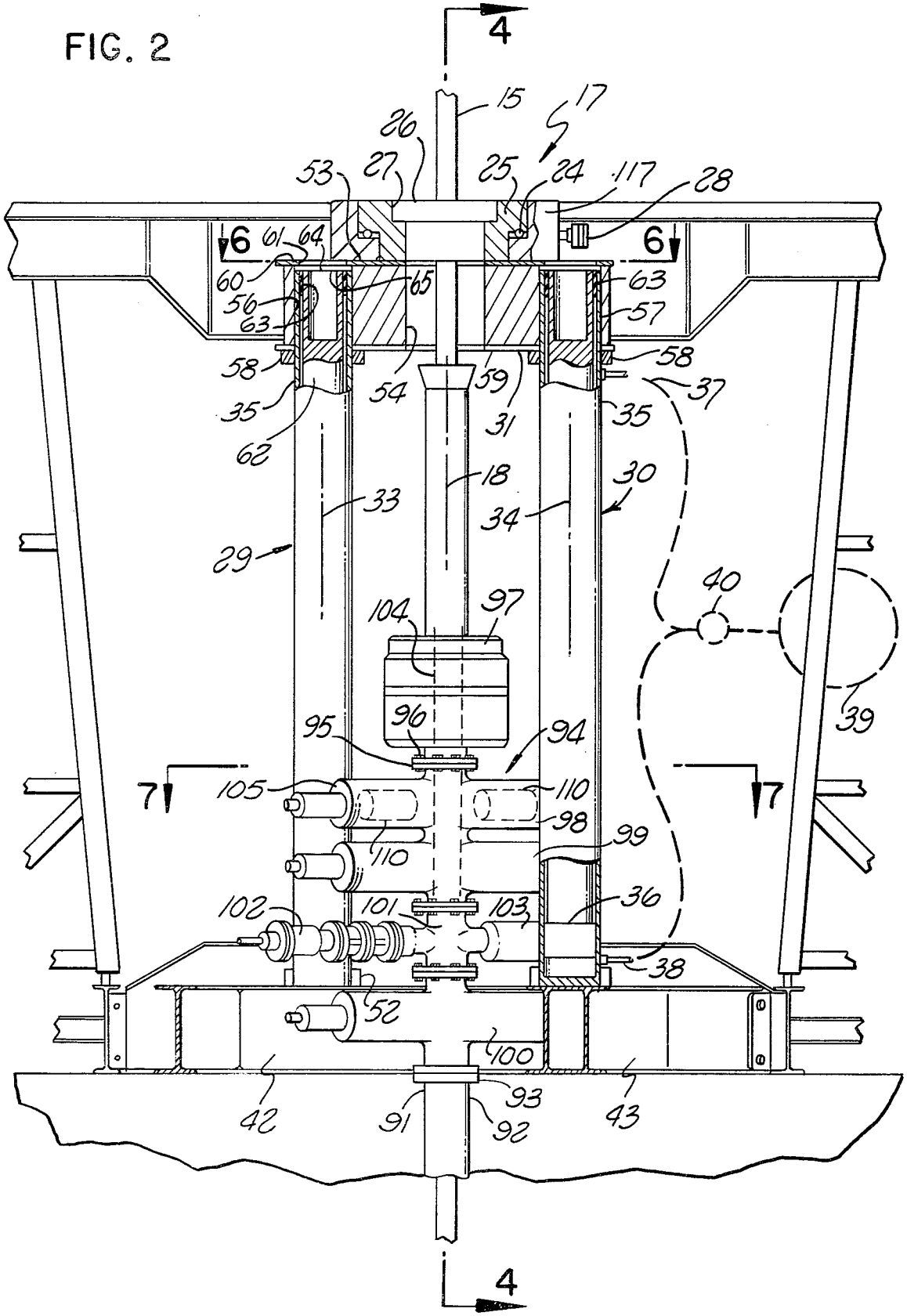
FIG. 2 is an enlarged fragmentary partially sectional view corresponding to a portion of FIG. 1.

The well drilling rig 10 illustrated in FIG. 1, which may be of conventional construction except as to the features of novelty specifically discussed hereinbelow, has the usual rig framework structure including a rig floor 11 a derrick or mast 12 projecting upwardly from the floor, and a substructure 13 supporting the floor and derrick on the surface of the earth 14. A tubular drill string 15 having an upper noncircular kelly section 16 is rotated by a standard rotary table 17 about a vertical axis 18 to drill a well 19 in the earth. The drill string is suspended by a traveling block 20 through a line 21 connected to crown block 22 attached to the upper end of the derrick, with the line being actuated by drawworks 23 to progressively lower the drill string so that a bit connected to its lower end drills the well. As seen in FIG. 2, rotary table 17 is typically illustrated as including an outer nonrotating rigid body 117 which acts through bearings represented at 24 to support an inner essentially annular part 25 for rotation about axis 18. A master bushing and kelly bushing assembly represented generally at 26 is received within vertical opening 27 in rotary part 25 and engages the kelly 16 in a relation driving it rotatively. Part 25 and the bushing assembly 26 are driven by the engine of drawworks 23 through a chain and sprocket drive 28.

During the drilling operation, rotary table 17 is supported by two piston and cylinder mechanisms 29 and 30, and a beam 31 extending between the upper ends of units 29 and 30. These elements 29, 30 and 31 function in the drilling condition of FIG. 2 as portions of the rotary table supporting structure, and function in the jacking condition of FIG. 3 as portions of the casing lowering or jacking mechanism identified generally by the number 32. Units 29 and 30 may be identical, and extend along two vertical axes 33 and 34 extending parallel to and offset equal distances from axis 18 at diametrically opposite locations. Each of the units 29 and 30 includes a vertical cylinder body 35 and a piston 36 mounted therein for powered movement upwardly and downwardly along axis 33 or 34 relative to the associated cylinder by introduction of pressurized hydraulic fluid into the cylinder above or beneath the piston head through lines 37 and 38 from a pressure fluid source 39 under the control of a valve represented diagrammatically at 40. Cylinders 35 are closed at their lower ends by bottom walls 41, which rest on and are supported by two essentially parallel rigid base members 42 and 43 connected at their opposite ends 44, 45, 46 and 47 to rigid members 48, 49, 50 and 51 of the rig substructure. The lower ends of the cylinders may be located relative to support members 42 and 43 by reception between lugs 52 which project upwardly from the upper horizontal surfaces of members 42 and 43 and form in effect socket recesses for receiving the lower ends of the cylinders and locating them against lateral movement.

Beam 31 is supported in fixed position, with its upper surface 53 disposed horizontally, by cylinders 35 of units 29 and 30, and is retained against horizontal movement by connection at a number of locations 131 (FIG. 6) to the rig substructure. This beam may be formed of a number of metal parts appropriately welded or otherwise secured rigidly together, but for simplicity of illustration and description is illustrated as a unitary one-piece member containing a central opening 54 for passing drill string 15 or a casing string 55 (FIG. 3) downwardly along axis 18. Near its opposite ends, beam 31 contains two vertical cylindrical passages 56 and 57 centered about axes 33 and 34 respectively and adapted to closely receive the upper ends of the two cylinders 35 in a relation locating beam 31 relative to the cylinders and locating the cylinders relative to one another. Two rings 58 extending about cylinders 35 and welded or otherwise secured rigidly thereto are engageable with the horiztonal under-surface 59 of beam 31 to support the beam through the cylinders. At the upper end of each cylinder, beam 31 may have an annular shoulder 60 projecting radially inwardly to a location overlying and vertically aligned with the cylinder wall and containing a reduced diameter circular opening 61 of a diameter corresponding to the internal diameter of cylinder 35 and slightly greater than the external diameter of piston rod 62 of the associated piston 36 to allow movement of the piston rod upwardly through opening 61 and to a location above the beam when rotary table 17 is not in position on the beam. Piston rod 62 may be externally cylindrical, and sealed with respect to cylinder 35 by an annular seal ring or gasket 63. In the drilling condition of FIG. 2, the upper annular end surface 64 of each piston rod 62 is at least as low as the plane of upper surface 53 of beam 31 and preferably slightly lower than that surface and flush with the upper ends of cylinders 35 in a horiztonal plane 65.

In the casing lowering condition of FIG. 3, rotary table 17 is removed from beam 31, and a piston rod extension unit 66 is connected to the upper ends of the piston rods for movement upwardly and downwardly therewith. This extension unit includes two vertical members 67 and 68 having reduced diameter ends 69 adapted to project downwardly into upper cylindrical recesses 70 formed in the upper ends of piston rods 62, with annular shoulders 71 formed on elements 68 between their upper enlarged diameter portions 72 and their reduced diameter portions 69 for engaging the upper horizontal surfaces 64 at the tops of the piston rods to actuate unit 66 upwardly and downwardly with the pistons. A rigid beam 73 is connected rigidly to the upper ends of the two elements 67 and 68, as by welding and by provision of braces 74 welded to elements 67, 68 and 73. Beam 73 contains an opening 75 through which casing 55 extends downwardly. Two pipe supporting units 76 and 77 are supported on the two beams 31 and 73 respectively, and are adapted to releasably engage and support a casing. These gripping units 76 and 77 may be identical and of a known type typically illustrated in FIG. 5. More specifically, each of the units 76 and 77 may include an outer rigid generally annular body 78 having downwardly tapering slip bowl surfaces 79 centered about axis 18 and engageable by a series of circularly spaced wedge slips 80 having outer surfaces 81 tapering in correspondence with and engaging slip bowl surfaces 79 to cam the slips progressively inwardly in response to downward movement of the slips. Inner gripping faces 82 of the slips are formed with teeth or other irregularities adapted to engage the outer surface of a casing 55 in a relation supporting the weight of the casing in the well. A ring 83 suspends the slips, through a number of links 84 pivotally connected at their opposite ends to the slips and ring. Ring 83 is power actuable upwardly and downwardly to raise and lower the slips between the pipe gripping positions represented in full lines in FIG. 5 and the upper released broken line positions in which the slips are retracted radially outwardly away from engagement with the casing. A number of piston and cylinder mechanisms 85, having their cylinders connected to body 78 and their pistons connected to ring 83, move the ring and slips upwardly and downwardly between their illustrated positions.

As seen in FIG. 4, the rig includes, in addition to the apparatus thus far described, a mousehole tube or pipe 86, which extends along an axis 87 disposed generally parallel to main axis 18 of the well and lying in a vertical plane 88 (FIG. 6) extending in a direction toward and away from drawworks 23. Axis 87 of the mousehole is inclined slightly to extend at a small angle a with respect to the true vertical and with respect to axis 18. Thus, as the mousehole extends downwardly it advances gradually and progressively away from axis 18. The mousehole is mounted in this position in any appropriate manner as by reception at its upper end within an opening 89 formed in beam 31 (FIG. 6) and by connection of its lower end to the substructure of the rig. The purpose of the mousehole is of course to receive a section of drill pipe which is to be added to drill string 15 or which has been removed from the drill string.

At an early stage during the drilling of a well, a string of surface casing 91 (FIG. 2) is lowered into the upper portion of the well, with the upper end of that surface casing forming a wellhead 92 having a flange 93 to which there is connected a blow-out preventer assembly 94 whose various elements are connected together by flanges 95 secured together in sealed relation by circularly spaced bolts 96. Assembly 94 may include an upper annular blowout preventer 97 containing an essentially annular sealing element constrictable against a drill pipe or casing to form a seal therewith. Beneath preventer 97, assembly 94 may include a number of ram type blowout preventers, 98, 99 and 100, with an intermediate tubular fitting 101 connected between two of these ram type preventers and providing connections to the usual kill line 102 and choke line 103 extending in opposite directions away from axis 18. As will be understood, all of the blowout preventers and fitting 101 contain vertical passages which are aligned with one another to define together a continuous vertical passage 104 though which a drill string or casing can extend downwardly from a location above assembly 94 through that assembly and into the well.

Each of the ram type blowout preventors 98, 99 and 100 includes a housing 105 defining part of the vertical passage 104 through assembly 94, with the housing 105 forming also two projections 106 and 107 extending in diametrically opposite directions away from axis 18 and carrying outer housing elements 108 terminating at radially outer extremities 109. The radial distance r between axis 18 and the extremity 109 of each of the projections 106 and 107 is greater than the radial distance R between axis 18 and mousehole tube 86 (FIG. 7), and is also greater than the radial distance $R_2$ between axis 18 and each of the cylinders 35. Projections 106 and 107 of each of the blowout preventers 98, 99, and 100 contain two rams 110 which are diametrically opposite one another and are movable toward and away from one another and act in their radially innermost positions to form seals preventing upward flow of well fluid. Two of the ram type blowout preventers (typically units 98 and 100) may have rams shaped to engage the outer surface of a drill string or casing string to form a seal thereabout, while the third preventer 99 may have rams shaped to form a closure entirely across passage 104 and thus close off upward flow of fluid from the well if no well pipe is present in that passage, with these rams being designed also as cutters capable of sharing a drill string or casing string if necessary. Kill line 102 allows ejection of pressure fluid into the well if desired, and choke line 103 permits controlled discharge of fluid from the well.

In order to avoid interference between the jacking mechanism and the other elements of the drilling rig located beneath the rig floor, the jacking cylinders and blowout preventers are preferably located in relative positions similar to those illustrated in FIG. 7. As seen in that figure, the vertical jacking cylinders 35 of piston and cylinder units 29 and 30 are positioned at diametrically opposite locations with respect to axis 18 and are both offset circularly about that axis from mousehole 86. Preferably, the axis of one of the piston and cylinder units 29 is offset circularly from the axis of mousehole 86 an angular distance b which is greater than the angular distance c between the axis of mousehole 86 and the axis of the other piston and cylinder unit 30. Also, the angle b is desirably greater than 90°, and the angle c is desirably less than 90°. One of the projections 106 of each of the ram type blowout preventers 98, 99 and 100 then projects radially outwardly away from axis 18 at a location circularly between piston and cylinder mechanism 29 and mousehole 86, with the relatively great angular spacing b between those elements serving to provide ample space for reception of that projection and for access to the blowout preventers, cylinders, and other elements for servicing. The kill line 102 also preferably extends radially outwardly at a location circularly between piston and cylinder mechanism 29 and mousehole 86, with the choke line 103 projecting in a diametrically opposite direction circularly between the two piston and cylinder units 29 and 30. The kill and choke lines 102 and 103 preferably extend essentially perpendicular to the previously mentioned vertical plane 88 containing the axis of the well and the axis of the mousehole 86.

All three of the ram type blowout preventors 98, 99 and 100 may be oriented to extend in the direction illustrated in FIG. 7 with respect to the other elements. It is contemplated that if desired all of these blowout preventors may be located at a level higher than the lower ends of cylinders 35 of units 29 and 30, or alternatively one or more of these ram type blowout preventers may be at a level beneath that of the lower extremities of the cylinders. In FIG. 2, an arrangement is illustrated in which the upper two ram type blowout preventers 98 and 99 are at a level above the lower extremities of cylinders 35, as are kill line 102 and choke line 103, while the lowermost ram type preventer 100 is beneath the level of the lower extremities of the cylinders, and is received between the two previously mentioned support or base members 42 and 43. To allow adequate space for reception of this bottom preventer 100, and allow access thereto for servicing, the two support beams 42 and 43 desirably extend generally parallel to the length dimension of blowout preventer 100, and are received at opposite sides of that preventer, which relationship will be apparent from FIG. 7. FIG. 6 illustrates the manner in which the upper passages 56 and 57 in beam 31 are offset circularly different distances from vertical plane 88 in correspondence with the angles b and c of FIG. 7 in order to receive and locate the upper ends of the cylinders 35 in the orientation discussed while maintaining the axes of the cylinders directly vertical.

To summarize briefly the manner in which the rig of FIGS. 1 through 7 is used to drill and then case a well, rotary table 17 is first positioned on beam 31 supported by piston and cylinder units 29 and 30 as shown in FIG. 2 and the well is drilled in conventional manner utilizing the rotary table to turn the drill string as it is gradually lowered into the well. The initial string of casing 91 is located in the well after a first portion of the well has been drilled, and blowout preventer assembly 94 is mounted to the wellhead in the relationship discussed above and illustrated specifically in FIGS. 2, 6 and 7 with respect to the mousehole and cylinders 35. After the drilling is completed, rotary table 17 is removed and extension unit 66 and gripping units 76 and 77 are connected to the upper ends of the piston and cylinder units as seen in FIG. 3. The main string of casing 55 (smaller in diameter than surface casing 91) is then lowered through blowout preventer assembly 94 into the well, and when the weight of the casing becomes great enough to approach the capacity of the derrick, drawworks, traveling block, crown block, etc., the jacking mechanism is brought into action to lower the casing 55 further into the well. Pistons 36 are actuated upwardly and downwardly to move the unit 77 upwardly and downwardly relative to unit 76, with unit 77 being actuated to its gripping condition during lowering movement to jack the casing downwardly, and with unit 76 being acuated to its gripping condition during upward movement of unit 77 in preparation for the next successive downward step.

FIG. 8 is a view corresponding to FIG. 7 but showing a variational arrangement which may be considered as identical with that of FIGS. 1 through 7 except with respect to the angular orientation of the various elements of the rig. In FIG. 8, the axis of mousehole tube **86*a* is offset circularly through angle d from plane 88*a* (corresponding to plane 88 of FIG. 6), while the longitudinal axis 111 of each of the ram type blowout preventers corresponding to preventers 98, 99 and 100 of FIG. 2 (one of which is represented at 98*a* in FIG. 8) may lie in plane 88*a*. The axes 33*a* and 34*a* of piston and cylinder units 29*a* and 30*a* (corresponding to units 29 and 30 of the first form of the invention) may lie in a vertical plane 112 perpendicular to plane 88*a*. Thus, as in the first form of the invention, the axis of one of the piston and cylinder mechanisms is offset circularly from the axis of the mousehole an angular distance e which is greater than the circular offset f between the axis of the mousehole and the axis of the other piston and cylinder unit, with one end of each of the ram type blowout preventers projecting radially outwardly from axis 18***a* at a location circularly between mousehole 86*a* and unit 29*a*, and with the kill line 102 also being received circularly between the mousehole and unit 29*a*, while choke line 103*a* projects in a diametrically opposite direction circularly between the two units 29*a* and 30*a*. As in the first form of the invention, one of the ram type blowout preventers may be located beneath the level of the lower extremities of the cylinders of units 29*a* and 30*a*, and project generally parallel to and between two support beams 42*a* and 43*a* corresponding to beams 42 and 43 of the first form of the invention. Thus, in FIG. 8 beams 42*a* and 43*a* may extend essentially parallel to plane 88*a* rather than at an angle thereto as in the first form of the invention. The orientation of FIG. 8 acts in a manner similar to that of FIGS. 1 through 7 to allow effective reception of the blowout preventers and other elements in closely confined relation beneath the rig floor while allowing access to the parts for repair and servicing. It is also contemplated that if desired the angles b and c of FIG. 7 or the angles e and f of FIG. 8 may in some instances each be 90°, leaving somewhat less space for reception of the ram type blowout preventers circularly between the mousehole and piston and cylinder 29 or 29*a*, and with the longitudinal axes of those blowout preventers then typically extending at angles of approximately 45° with respect to plane 88 or 88*a* to be essentially midway between the mousehole and unit 29 or 29*a*.

FIG. 9 illustrates a variational arrangement in which the rotary table (not shown) may be supported in conventional manner during the drilling operation on the usual rotary table support beams 113, and in which the jacking mechanism 114 is entirely removed from the rig during drilling and then moved into position only when it is desired to lower casing 115 into the well. In FIG. 9, the two piston and cylinder mechanisms 29*b* and 30*b* similar to units 29 and 30 of the first form of the invention may have the bottom end walls 41*b* of their cylinders 35*b* supported on two rigid vertical columns 116 whose lower ends rest on a base structure 117 supported by the ground. Columns 116 thus form in effect vertical continuations of cylinders 35*b*, and these columns and cylinders form together two vertical parallel subfloor structures extending upwardly from the ground along two parallel vertical axes 33*b* and 34*b* to and above the level of rig floor 11*b*. The upper ends of cylinders 35*b* project upwardly through openings in the opposite ends of the beams 31*b* and to upper extremities 118 of the cylinders, with beam 31*b* being supported by the cylinders through rings 58*b* welded to the cylinders and engaging upwardly against the underside of the beam. Upper beam 73 is detachably connectible to the upper ends of the piston rods of units 29*b* and 30*b*, with gripping units 76*b* and 77*b* being supported on beams 31*b* and 73*b* respectively. Ram type blowout preventers 98*b*, 99*b* and 100*b* corresponding to preventers 98, 99 and 100 of FIG. 2 may be located below the level of the lower extremities 41*b* of cylinders 35*b* in FIG. 9, and at the level of the lower support columns 116. The mousehole (not illustrated in FIG. 9) may be positioned either as shown in FIG. 7 or as shown in FIG. 8, and columns 116 may be located with their vertical axes 33*b* and 34*b* either at the locations of axes 33 and 34 in FIG. 7 or at the locations of axes 33*a* and 34*a* in FIG. 8, with one end of each of the ram type blowout preventers 98*b*, 99*b* and 100*b* being located circularly between the mousehole and the support column 116 which supports and is vertically aligned with piston and cylinder unit 29*b*. This relationship will be apparent from the prior discussion of the earlier forms of the inventions.

FIG. 10 shows fragmentarily another variation which may be considered the same as that of FIGS. 1 through 7 or that of FIG. 8, except that the lower ends of piston and cylinders units 29*c* and 30*c* (corresponding to units 29 and 30 or 29*a* and 30*a*) are supported on opposite ends of a generally horizontal beam 119 which is connected to and supported by wellhead 92*c* rather than being supported on the ground as in FIG. 2. In accordance with the teachings of our copending application Ser. No. 333,031, filed 12/21/81 on "Jacking Mechanism Supported by Wellhead", beam 119 may have a central tubular portion 120 connected into the blowout preventer assembly 94*c*, with portions of the beam projecting in diametrically opposite directions from that central portion 120 to support the two piston and cylinder units and the remainder of the jacking mechanism, and to also support the rotary table in the manner illustrated in FIGS. 1 and 2 if desired. One or more of the ram type blowout preventers 98*c*, 99*c* and 100*c* (typically all of them as illustrated in FIG. 10) are located at a level above that of the lower extremities of the cylinders 29*c* and 30*c*, with one end of each of these preveters extending radially outwardly at a location circularly between the mousehole (not shown in FIG. 10) and unit 29*c* as discussed in detail in connection with the earlier forms of the invention.

While certain specific embodiments of the present invention have been disclosed as typical, the invention is of course not limited to these particular forms, but rather is applicable broadly to all such variations as fall within the scope of the appended claims.

We claim:

1. A well rig convertible between a drilling condition and a casing lowering condition and including:

a mast or derrick which projects upwardly above the well in both of said conditions;

a rig floor received above the well in both of said conditions;

said rig being operable in said drilling condition to drill a well utilizing a drill string suspended by said mast or derrick and extending along a predetermined axis relative to the mast or derrick and through the rig floor and downwardly into the well;

a tubular mousehole extending downwardly beneath the level of the rig floor and generally parallel to said axis at a location offset in a predetermined horizontal direction from the axis and adapted to receive and hold a section of pipe which is to be added to or has been removed from a drill string;

jacking mechanism which in said casing lowering condition of the rig is at a location near the lower end of said mast or derrick, and is operable to lower a string of casing along said axis and into the drilled well;

said jacking mechanism including two casing supporting units accessible from above the rig floor and operable to support the casing string alternately, and a plurality of load supporting and actuating structures which support said units and project downwardly beneath the level of the rig floor at different sides of said axis and each of which is offset circularly about said axis from said mousehole;

said structures including fluid pressure operated piston and cylinder mechanisms projecting downwardly beneath the level of the rig floor for actuating one of said units upwardly and downwardly relative to the other to progressively lower the casing string;

said jacking mechanism being constructed to support a casing string having a weight greater than the load supporting capacity of said mast or derrick, and to transmit load forces resulting from the weight of said casing string from each of said supporting units downwardly through said structures to the earth, with said mast or derrick projecting upwardly above the jacking mechanism, but without transmission of said load forces through the mast or derrick or through the rig floor to the earth; and at least one blowout preventer beneath said rig floor operable to close off unwanted upward flow of well fluid from the well and having a portion which projects laterally outwardly away from said axis at a location circularly between said mousehole and one of said load supporting and actuating structures of the jacking mechanism.

2. A well rig as recited in claim 1, in which said one of said load supporting structures is offset circularly about said axis from the mousehole farther than is another of said structures.

3. A well rig as recited in claim 1, in which said one of said structures is offset circularly about said axis from the mousehole more than 90 degrees, and a second of said structures is offset circularly about said axis from the mousehole less than 90 degrees.

4. A well rig as recited in claim 1, including choke and kill lines communicating with the well and extending laterally away from said axis in generally opposite directions and one of which is received circularly between said mousehole and one of said structures.

5. A well rig as recited in claim 1, including a wellhead, and projections extending laterally from and supported by said wellhead and acting to support two of said structures respectively of the jacking mechanism.

6. A well rig as recited in claim 1, including a wellhead, and a beam connected to and supported by said wellhead and projecting in opposite directions from said axis at a location lower than said one blowout preventer and acting to support said two structures.

7. A well rig as recited in claim 1, including a first beam supported by the cylinders of said piston and cylinder units and operable during drilling to support a rotary table and during a jacking operation to support one of said gripping units, the pistons of said piston and cylinder mechanisms having upwardly extending rods, said rig including an extension structure connectible to said rods of the pistons and projecting upwardly therebeyond and actuable upwardly and downwardly therewith during a jacking operation to support and move the second of said gripping units, said extension means being removable from said rods of the pistons during a drilling operation.

8. A well rig as recited in claim 1, in which said blowout preventer is at a level horizontally opposite portions of said piston and cylinder mechanisms and circularly between one of said mechanisms and said mousehole.

9. A well rig as recited in claim 1, in which each of said structures has a lower support column portion extending downwardly beyond the piston and cylinder mechanism of said structure and supporting it from the ground, said blowout preventer being at a level downwardly beyond the lower extremities of said piston and cylinder mechanisms and horizontally opposite said lower support column portions of said structures and circularly between said mousehole and said support column portion of said one structure.

10. In a rig for drilling a well along a predetermined axis, the combination comprising:

a rig floor;

a tubular mousehole extending downwardly beneath the level of the rig floor and generally parallel to said axis at a location offset in a predetermined horizontal direction therefrom and adapted to receive and hold a section of pipe which is to be added to or has been removed from a drill string;

jacking mechanism for moving a well casing along said axis and including first and second pipe supporting units at least one of which is accessible above the rig floor and a plurality of structures extending downwardly beneath the level of said rig floor at different sides of said axis, said structures including power operated piston and cylinder mechanisms for moving one of said pipe supporting units upwardly and downwardly relative to the other in a relation jacking a well casing downwardly along said axis; and at least one blowout preventer beneath said rig floor operable to close off unwanted upward flow of well fluid from the well and having a portion which projects laterally outwardly away from said axis at a location circularly between said mousehole and one of said structures of the jacking mechanism.

11. The combination as recited in claim 10, in which said one structure of the jacking mechanism is off-set circularly about said axis more than 90° from said mousehole.

12. The combination as recited in claim 10, in which said blowout preventer has a flow control ram mounted for movement essentially toward and away from said axis at said location circularly between said mousehole and said one structure of the jacking mechanism.

13. The combination as recited in claim 10, including a wellhead to which said blowout preventer is connected, and means supporting said structures of the jacking mechanism at least in part from said wellhead.

14. The combination as recited in claim 10, including a line communicating with the well and extending laterally away from said axis at a location circularly between said mousehole and one of said structures of the jacking mechanism.

15. The combination as recited in claim 10, including extension means detachably connectible to said structures and projecting upwardly therebeyond for supporting one of said pipe supporting units and removable from said structures during a drilling operation.

* * * * *